US011007517B2

(12) United States Patent
Petrek

(10) Patent No.: US 11,007,517 B2
(45) Date of Patent: May 18, 2021

(54) SUB-ONE MICROLITER PIPETTE

(71) Applicant: Mettler-Toledo Rainin, LLC, Oakland, CA (US)

(72) Inventor: James S. Petrek, Danville, CA (US)

(73) Assignee: Mettler-Toledo Rainin, LLC, Oakland, CA (US)

( * ) Notice: Subject to any disclaimer, the term of this patent is extended or adjusted under 35 U.S.C. 154(b) by 507 days.

(21) Appl. No.: 15/727,020

(22) Filed: Oct. 6, 2017

(65) Prior Publication Data

US 2018/0099270 A1 Apr. 12, 2018

Related U.S. Application Data

(60) Provisional application No. 62/405,389, filed on Oct. 7, 2016.

(51) Int. Cl.
*B01L 3/02* (2006.01)

(52) U.S. Cl.
CPC ..... *B01L 3/0217* (2013.01); *B01L 3/0275* (2013.01); *B01L 2200/0689* (2013.01); *B01L 2200/14* (2013.01); *B01L 2300/0681* (2013.01); *B01L 2300/0832* (2013.01); *B01L 2300/123* (2013.01)

(58) Field of Classification Search
None
See application file for complete search history.

(56) References Cited

U.S. PATENT DOCUMENTS

| | | | | |
|---|---|---|---|---|
| 3,101,084 | A * | 8/1963 | Hamilton | A61M 5/31531 604/207 |
| 4,004,718 | A * | 1/1977 | Wesley | A61M 5/31531 222/386 |
| 4,820,278 | A * | 4/1989 | Balisky | A61M 5/3129 604/218 |
| 5,242,423 | A * | 9/1993 | Goodsir | A61M 39/02 604/243 |
| 5,639,426 | A * | 6/1997 | Kerr | B01L 3/0275 422/501 |
| 6,871,557 | B2 | 3/2005 | Magnussen, Jr. et al. | |
| 2014/0219887 | A1* | 8/2014 | Sheldon | B01L 3/0279 422/509 |

OTHER PUBLICATIONS

Socorex Swiss, "Digital Reading Micropipettes," N/A, Wheaton Science Products, WSP Lit. No. 7736-0407 (Year: 2019).*
Accuris Instruments, photos of NextPette 1uL pipette taken Sep. 25, 2017, 4 pages.

(Continued)

*Primary Examiner* — Jill A Warden
*Assistant Examiner* — Brittany I Fisher
(74) *Attorney, Agent, or Firm* — Standley Law Group LLP; Jeffrey S. Standley; Eric M. Gayan

(57) ABSTRACT

A sub-1 μL pipette having a small diameter metal tube that is concentrically located within the tip mounting shaft/portion of the pipette and extends from the distal end thereof by some predetermined distance so as to seal against the interior of a pipette tip that is installed to the tip mounting portion. The use of a small diameter metal tube and sealing of the metal tube against the inner surface of the pipette tip near a distal opening of the pipette tip allows for a minimal ullage volume.

33 Claims, 7 Drawing Sheets

(56) References Cited

OTHER PUBLICATIONS

Accuris Instruments, NextPette Adjustable Volume Pipettes, no date on document, accessed online Feb. 27, 2019 at http://www.accuris-usa.com/Products/nextpette-precision-pipettes/, 4 pages.
Accuris Instruments, NextPette Instruction Manual, no date on document, accessed online Feb. 27, 2019 at http://www.accuris-usa.com/Products/nextpette-precision-pipettes/, 12 pages.
Accuris Instruments, NextPette Precision Pipettes, webpage accessed online Mar. 8, 2019 at http://www.accuris-usa.com/Products/nextpette-precision-pipettes/, 2017, 6 pages.

* cited by examiner

SUB-ONE MICROLITER PIPETTE

CROSS-REFERENCE TO RELATED APPLICATIONS

This application claims the benefit of U.S. Provisional Application No. 62/405,389, filed on Oct. 7, 2016, which is hereby incorporated by reference as fully recited herein.

TECHNICAL FIELD

Exemplary device embodiments described herein are directed generally to pipettes and, more particularly, to extremely small displacement pipettes.

BACKGROUND

Generally speaking, and as would be well understood by one of skill in the art, a pipette is a device that is normally used in conjunction with a pipette tip to transfer or distribute a measured volume of liquid from one location to another. Air-displacement pipettes, which are of the most interest with respect to this application, operate generally by creating a vacuum via the retraction of a piston located in the pipette body. Thus, when the open end of an associated pipette tip is submersed in a liquid, the resulting vacuum draws air from the pipette tip and an amount of the liquid is consequently drawn into the tip to replace the evacuated air. Movement of the pipette piston is regulated such that a desired measured amount of liquid is drawn into the tip during the aspiration phase of the pipetting operation.

Air-displacement pipettes are available in a wide volume range of between about 0.2 μL to several thousand μL. However, despite the fact that small volume air-displacement pipettes are available, pipetting volumes below 1 μL has remained very difficult. For example, a recent survey of researchers who own 2 μL pipettes and pipette liquids at volumes of 1 μL and lower, revealed that close to 50% of respondents identified inaccuracy and low precision as a major problem.

After ample research, it is believed that the ongoing difficulties associated with sub-1 μL pipetting are attributable to several different factors. One factor is believed to be the lack of inertia of the liquid dispensed from a pipette tip at sub-1 μL volume levels. That is, when expelled from a pipette tip, very small liquid volumes lack the inertia that is clearly present in larger dispense volumes (e.g., 1,000 μL). In the case of such a larger dispense volume, all of the liquid will be expelled with significant inertia out of the pipette tip without the need to touch off the tip on the side of the containing vessel. This is not the case when a sub-1 μL liquid volume is dispensed.

Another factor that is believed to contribute to the difficulties associated with sub-1 μL pipetting is the capillary action of the pipetted liquid and the surface energy of the plastic from which the pipette tip is molded. Particularly, the capillary action of the liquid is stronger in a small-diameter, small-volume pipette tip, which tends to retain liquid in the tip.

Another factor that is believed to contribute to the difficulties associated with sub-1 μL pipetting is ullage volume which, as used herein, is defined as the volume of air in the pipette and tip above the surface of aspirated liquid in the tip. Because the pipetting aspiration process always starts with the pipette piston in the same location, and the ullage volume is independent of the pipette volume setting and the amount of liquid aspirated, the ullage volume can be calculated from the geometry of the pipette piston, seal, shaft and tip.

It has been determined that the ratio of the aspirated liquid volume to the ullage volume is a good indicator of how "stiff" the pipette system is and how effective the dispense stroke of the pipette will be. Because this ratio is unfavorable in most small volume (e.g., below 20 μL) pipettes, many manufacturers use an extended blowout stroke to ensure that all of the aspirated liquid will be dispensed from the pipette tip.

While pipetting sub-1 μL liquid volumes has remained very difficult, the need to pipette such small liquid volumes has grown significantly. There are several reasons for the increased demand, most likely led by the increasing cost of reagents. In any case, there is an evident need for an improved sub-1 μL pipette. Exemplary pipette embodiments described and shown herein meet this need.

SUMMARY

An exemplary hand-held sub-1 μL pipette embodiment described herein will generally include a body portion, a tip mounting shaft or portion attached to or integral to the body portion at the distal end thereof, a piston assembly including a piston, a stroke spring, and a plunger button attached to a plunger rod. In typical fashion, the stroke spring may drive the piston during a liquid aspiration phase of a pipetting operation and the plunger button and associated rod may be subsequently depressed by a user to dispense the aspirated liquid. Other elements such as but not limited to, volume setting components, a blowout spring, and a tip ejector and ejector button may also be present.

In a common pipette of similar design, the piston reciprocates directly within the tip mounting shaft, which is the most distally-located pipette component. An inner wall of a pipette tip mounting portion seals against a mating outer wall of the tip mounting shaft upon proper installation of the pipette tip. In such common pipettes—particularly those of smaller volume (e.g., 2 μL to 20 μL) that use small volume tips—it is not possible to produce a corresponding molded plastic tip mounting shaft that is capable of sealing deep enough in the pipette tip to effectively minimize the ullage volume. Consequently, in the case of existing small volume pipettes and associated pipette tips, the sealing point of the tip mounting shaft to the pipette tip has until now occurred at an undesirably large distance from the opening at the distal end of the pipette tip.

In an exemplary sub-1 μL pipette embodiment as described and shown herein, the ullage volume is greatly reduced by utilizing a small diameter metal tube that is concentrically located within the tip mounting shaft and extends from the distal end thereof by some predetermined distance so as to seal against the interior of a liquid handling portion of a pipette tip that is installed to the tip mounting shaft. The small diameter and substantially rigid nature of the metal tube allows the seal with the pipette tip to occur much closer to the distal end (opening) of the pipette tip than has been previously possible, thereby permitting the aforementioned reduction in ullage volume. For example, the hollow metal tube may seal with a given pipette tip at a location proximate the expected location of the surface of a maximum volume of liquid that can be aspirated into the pipette tip at a given pipette volume setting. Alternatively, the hollow metal tube may seal with a given pipette tip at a location slightly above a minimum length pipette filter, where the bottom of the filter is located slightly above the expected location of the surface of a maximum volume of liquid that can be aspirated into the pipette tip at a given pipette volume setting. In either case, the "given pipette volume setting" may be a selected aspiration volume setting of a volume adjustable pipette, or a fixed aspiration volume of a non-volume adjustable pipette.

Additionally, in an exemplary sub-1 μL pipette embodiment, the piston travels within the metal tube rather than a normal plastic tip mounting shaft. The clearance between the piston and the inner diameter of the metal tube may be significantly reduced in comparison to the clearance typically required between a piston and a (molded) plastic tip mounting shaft, allowing for a further reduction in ullage volume.

Because the metal tube will protrude from the tip mounting shaft of the pipette body, it is contemplated that a protective sleeve may be provided to shield the protruding portion of the metal tube prior to installation of a pipette tip. In one exemplary embodiment, the protective sleeve may be a retractable sleeve that is a part of the tip mounting shaft of the pipette. In another exemplary embodiment, the protective sleeve may be a retractable sleeve that is a part of a tip ejector of the pipette.

In another alternative embodiment, shielding the protruding portion of the metal tube may be accomplished using a specially-designed tip mounting shaft in conjunction with a complimentarily-designed pipette tip. Particularly, the distal end of the tip mounting shaft may extend slightly past the distal end of the metal tube and may include an axial cavity into which a distal end of the metal tube extends. The diameter of the cavity is larger than the outer diameter of the metal tube so as to provide an annular gap therebetween that is of sufficient dimension to receive therein a sealing region of the pipette tip. Consequently, the metal tube may seal with the inner surface of the pipette tip as described above, without the metal tube projecting beyond the end of the tip mounting shaft.

Other aspects and features of the general inventive concept will become apparent to those skilled in the art upon review of the following detailed description of exemplary embodiments along with the accompanying drawing figures.

BRIEF DESCRIPTION OF THE DRAWINGS

In the following descriptions of the drawings and exemplary embodiments, like reference numerals across the several views refer to identical or equivalent features, and.

DETAILED DESCRIPTION OF THE EXEMPLARY EMBODIMENT(S)

Figure 1A:
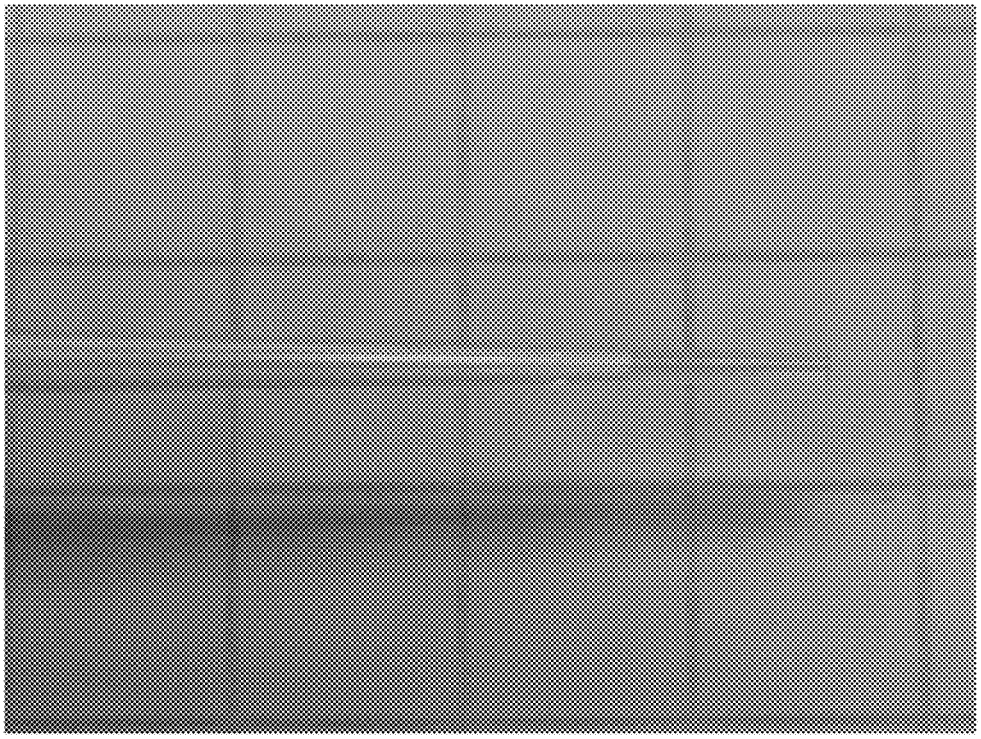
FIG. 1A is a photograph showing 1 μL of liquid aspirated into an existing pipette tip using an existing pipette having an adjustable volume of between 0.2 μL to 2 μL.
Figure 1B:
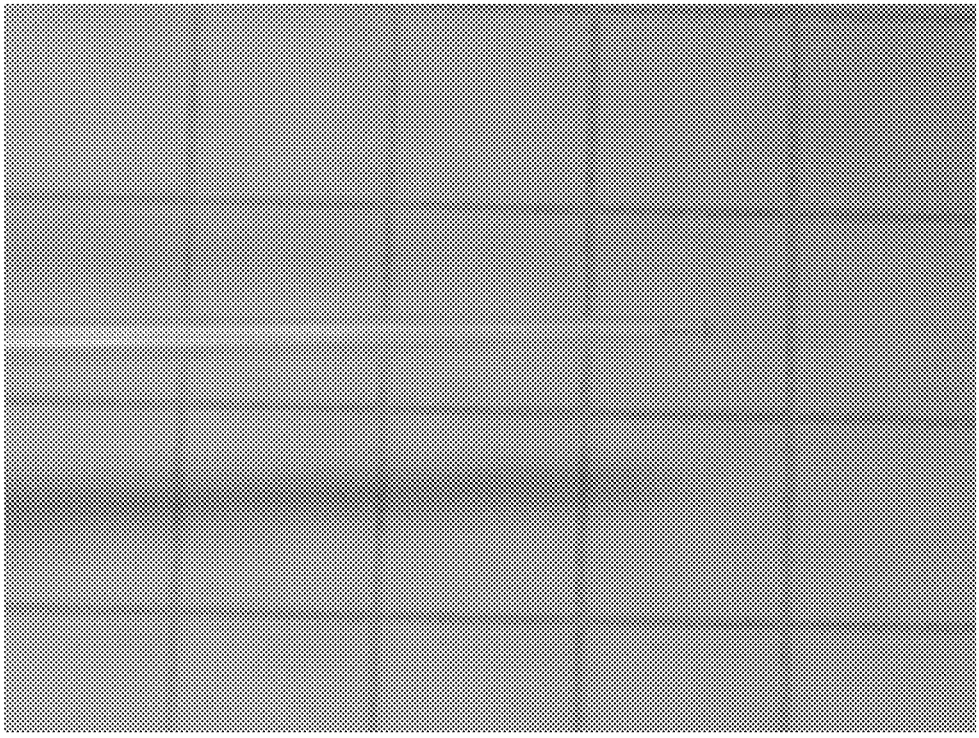
FIG. 1B is a photograph showing an amount of liquid remaining in the pipette tip of FIG. 1A after the plunger of the pipette has been moved to the end of the dispense stroke but before blowout is initiated.

FIGS. 1A-1B illustrate the difficulties associated with precisely and accurately pipetting sub-1 μL liquid volumes using existing pipette technology. More specifically, FIG. 1A shows 1 μL of liquid aspirated into an existing pipette tip using an existing pipette having an adjustable volume of between 0.2 μL to 2 μL. FIG. 1B shows the pipette tip of FIG. 1A after the plunger of the pipette has been moved to the end of the dispense stroke but before blowout is initiated. As is clearly observable, a substantial volume of liquid undesirably remains in the pipette tip after the dispense stroke.

Figure 2A:
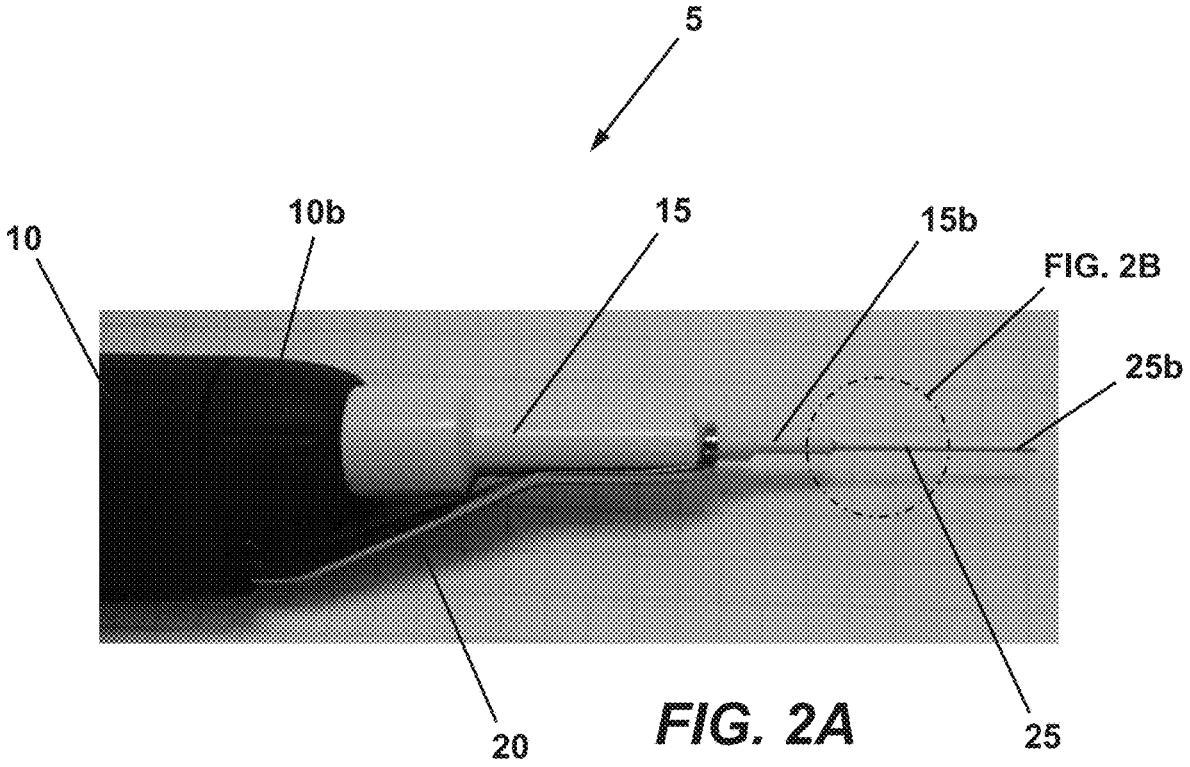
FIG. 2A depicts the liquid end of an exemplary prototype sub-1 μL pipette.
Figure 2B:
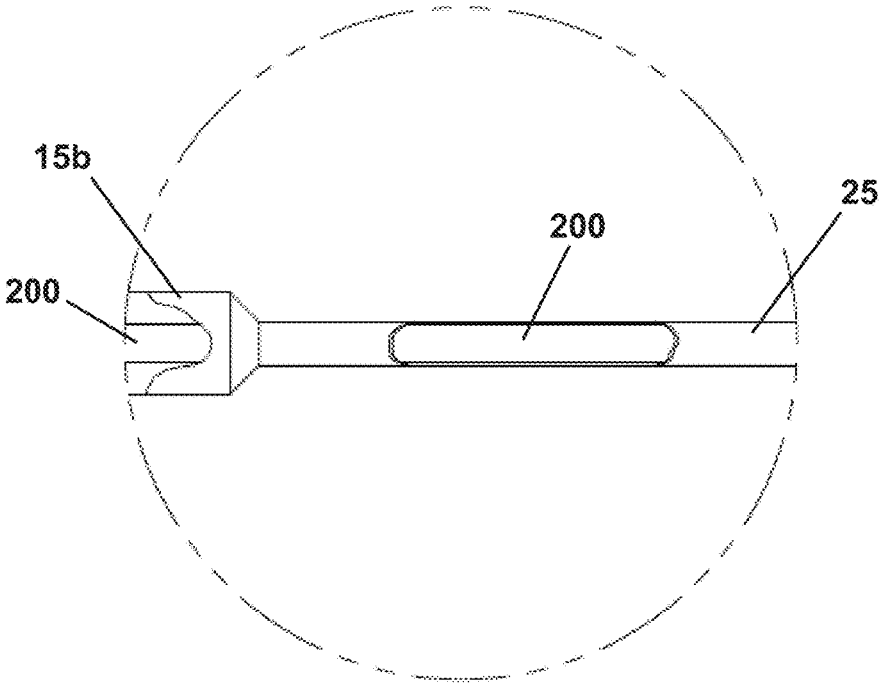
FIG. 2B is an enlarged and partially cutaway view of a portion of the liquid end of the exemplary prototype sub-1 μL pipette of FIG. 2A.

Inventive sub-1 μL pipette embodiments are designed to overcome problems such as the residual liquid problem illustrated in FIGS. 1A-1B. The liquid end of one such exemplary (but prototype) hand-held sub-1 μL pipette embodiment 5 is shown in FIG. 2 FIGS. 2A-2B. As shown in FIG. 2A, the pipette 5 includes a body portion 10 for gripping by a user, a tip mounting shaft 15 attached to the body portion at the distal end 10*b* thereof, and a tip ejector 20 for ejecting a pipette tip from the tip mounting shaft. As would be understood by one of skill in the art, the pipette 5 would also generally include a piston assembly that resides at least partially within the body portion 10. A piston 200 of the piston assembly extends distally toward the liquid end of the pipette 5, as illustrated in the enlarged and partially cutaway view of FIG. 2B. A plunger rod would extend proximally from the piston 200 and may include a plunger button external to the body portion 10 for engagement by a user. A stroke spring may also be located within the body portion to drive the piston 200 proximally during a liquid aspiration phase of a pipetting operation, and the plunger button and associated rod may be subsequently depressed by a user to dispense the aspirated liquid. Further non-shown pipette elements may also be present, including but not limited to, volume setting components, a blowout spring, and an ejector button for activating the tip ejector 20. Other designs are also possible.

As previously mentioned, the sealing point of a tip mounting shaft to a pipette tip normally occurs at a substantial distance from the distal opening in the pipette tip—thereby contributing to an undesirably large ullage volume. To combat this excessive ullage problem, the liquid end of the exemplary sub-1 μL pipette embodiment 5 illustrated in FIGS. 2A-2B includes a very small diameter metal tube 25 that is concentrically arranged within the tip mounting shaft 15 and within which travels the pipette piston 200. As shown, the metal tube 25 protrudes from the distal end 15*b* of the tip mounting shaft 15. The distance by which the metal tube 25 protrudes from the tip mounting shaft 15 is selected such that the distal end 25*b* of the metal tube will contact and seal against the inner wall of a liquid handling portion of a pipette tip that is installed to the tip mounting shaft.

In the exemplary pipette embodiment 5 shown in FIGS. 2A-2B, the inner and outer diameters of the metal tube 25 are 0.0165 inches and 0.027 inches, respectively, although the metal tube of a given exemplary embodiment is not limited to these dimensions. The material from which the metal tube 25 is constructed in the exemplary embodiment of FIGS. 2A-2B is Nitinol, which is a nickel and titanium alloy. Nitinol was selected as the material for the metal tube 25 of the exemplary pipette embodiment 5 shown in FIGS. 2A-2B because it has superelastic properties—which should allow the metal tube to be sharply bent or smashed and still spring back without taking a set. The metal tube used in other embodiments may be constructed from other materials.

The inclusion of the metal tube 25 provides several benefits. First, the small diameter and substantially rigid nature of the metal tube 25 allows the seal with the pipette tip to occur much closer to the opening at the distal end of the pipette tip than has been previously possible (see FIGS. 4-6), thereby producing a reduction in ullage volume. Additionally, as opposed to traveling within a typical plastic tip mounting shaft, the piston 200 of the sub-1 μL pipette 5 travels within the metal tube 25. Because the metal tube 25 can be manufactured with a bore having a smaller inner diameter and tighter tolerance than a comparable, molded plastic tip mounting shaft, the clearance between the pipette piston 200 and the inner diameter of the metal tube 25 may be significantly reduced. This reduction in clearance further contributes to a diminished ullage volume.

Figure 3A:
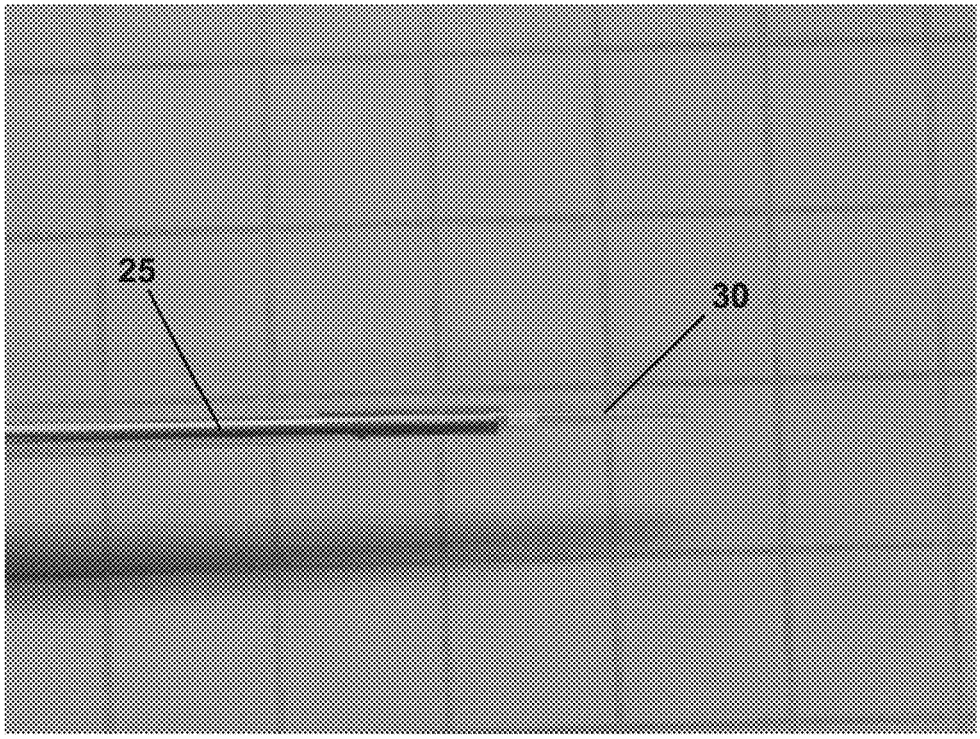
FIG. 3B is a photograph showing a de minimis amount of liquid remaining in the pipette tip of FIG. 3A after the plunger of the sub-1 μL pipette has been moved to the end of the dispense stroke but before blowout is initiated.
Figure 3B:
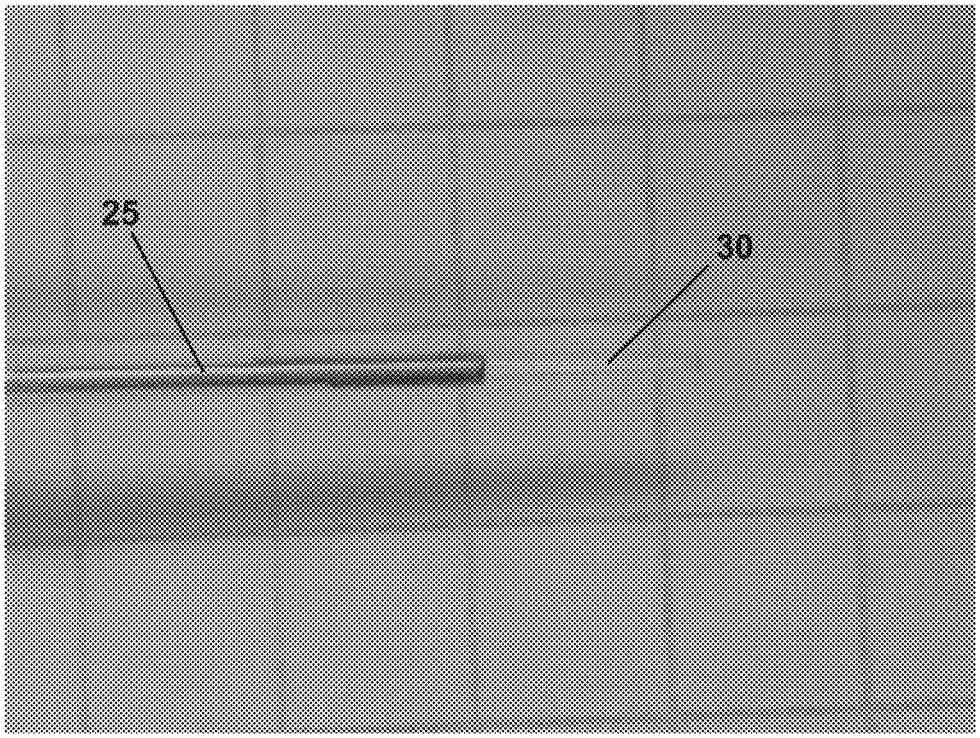

The improvement in pipetting sub-1 μL volume levels afforded by an exemplary sub-1 μL pipette, such as the pipette 5 of FIGS. 2A-2B, may be observed in FIGS. 3A-3B. FIG. 3A shows 14 of liquid aspirated into an existing pipette tip 30 using the prototype exemplary pipette 5 of FIGS. 2A-2B. FIG. 3B shows the pipette tip 30 of FIG. 3A after the plunger of the pipette 5 has been moved to the end of the dispense stroke but before blowout is initiated. As is clearly observable, virtually no liquid remains in the pipette tip after the dispense stroke, thus greatly improving the precision and accuracy of pipetting sub-14 volume levels in comparison to known pipetting technology. It should also be noted that the prototype exemplary pipette 5 of FIGS. 2A-2B was created by modifying an existing MT-Rainin L-2XLS+ pipette having an adjustable volume of between 0.24 to 24, and that the test results illustrated in FIGS. 3A-3B were achieved by fitting a standard MT-Rainin RT-L10 pipette tip to the prototype pipette. While the modifications made to the L-2XLS+ pipette reduced the ullage volume from approximately 47.54 to approximately 3.74 (a 92% reduction), it is nonetheless expected that even further improvements in precision and accuracy may be achieved through development of a production level sub-1 μL pipette and complimentary pipette tip.

As should be apparent from observation of the exemplary sub-1 μL pipette 5 of FIGS. 2A-2B and the foregoing description, the diminutive dimensions of the metal tube 25 render the protruding portion thereof delicate and easily damaged. Consequently, an exemplary sub-1 μL pipette may include a structure that protects the metal tube thereof from being damaged.

Figure 4:
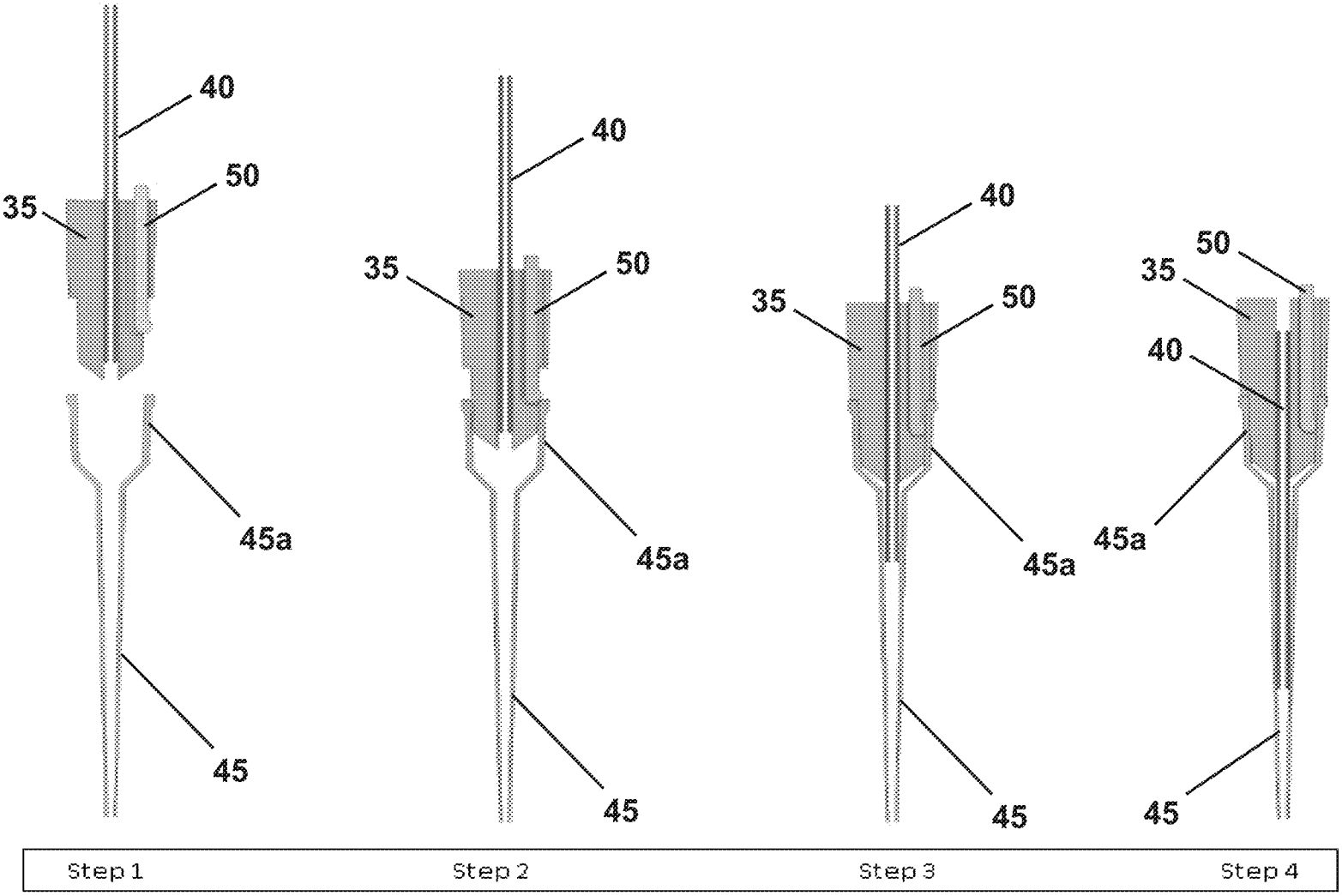
FIG. 4 schematically illustrates one exemplary embodiment of a retractable protective sleeve element of an exemplary sub-1 μL pipette, along with its method of operation.

One exemplary embodiment of such a metal tube protective structure is depicted in FIG. 4. In this exemplary embodiment, the protective structure takes the form of an assembly including a retractable protective sleeve 35 that is a part of the tip mounting shaft of an associated sub-1 μL pipette. As shown, what would otherwise be the protruding distal end of the metal tube 40 is located within the protective sleeve 35 prior to installation of a pipette tip 45.

The metal tube protective assembly of FIG. 4 further includes a lever 50 that extends through a passage in the protective sleeve 35 and includes a distal end portion that protrudes partially through an opening in the side of the protective sleeve. The lever is engageable with a locking mechanism (not shown) that prohibits retraction of the protective sleeve 35 when no pipette tip 45 is installed to the pipette (or the lever is not otherwise intentionally depressed). However, as illustrated by Steps 3-4 of FIG. 4, as the pipette tip 45 is installed over the protective sleeve 35, an interior wall of a proximal mounting portion 45*a* of the pipette tip 45 eventually depresses the protruding distal end portion of the lever 50. Depression of the lever 50 releases the locking mechanism, which allows the protective sleeve 35 to retract in a proximal direction, thereby exposing the metal tube 40 and allowing the distal end of the metal tube to enter a liquid handling portion of the pipette tip 45 and to seal against the interior wall thereof as the protective sleeve becomes fully retracted.

Figure 5:
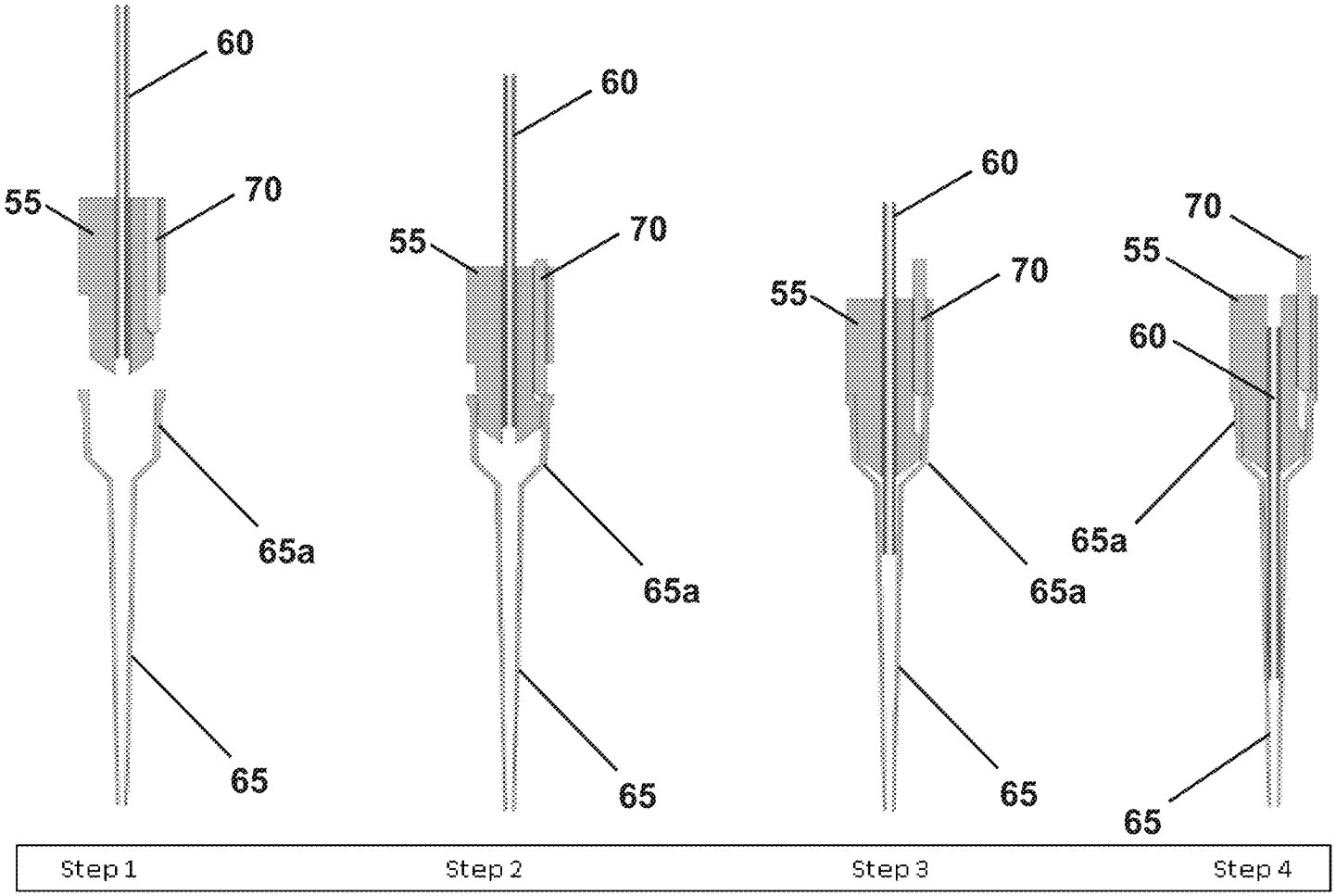
FIG. 5 schematically illustrates another exemplary embodiment of a retractable protective sleeve element of an exemplary sub-1 μL pipette, along with its method of operation.

Another exemplary embodiment of a metal tube protective structure is depicted in FIG. 5. In this exemplary embodiment, the protective structure again takes the form of an assembly including a retractable protective sleeve 55 that is a part of the tip mounting shaft of an associated sub-1 μL pipette. As shown, what would otherwise be the protruding distal end of the metal tube 60 is again located within the protective sleeve 55 prior to installation of a pipette tip 65.

The metal tube protective assembly of FIG. 5 further includes a sliding lever 70 that extends through a passage in the protective sleeve 55 and includes a distal end portion that is exposed within an opening in the side of the protective sleeve. The lever 70 is engageable with a locking mechanism (not shown) that prohibits retraction of the protective sleeve 55 when no pipette tip 65 is installed to the pipette (or the lever is not otherwise intentionally slid proximally). However, as illustrated in Step 2 of FIG. 5, as the pipette tip 65 is installed over the protective sleeve 55, a leading face of the proximal mounting portion 65*a* of the pipette tip 65 eventually contacts the exposed distal end of the lever 70. As indicated by Steps 3-4 of FIG. 5, further installation of the pipette tip 65 causes the lever 70 to slide in a proximal direction, which releases the locking mechanism and allows the protective sleeve 65 to retract in a proximal direction, thereby exposing the metal tube 60 and allowing the distal end of the metal tube to enter a liquid handling portion of the pipette tip 65 and to seal against the interior wall thereof as the protective sleeve becomes fully retracted.

Figure 6:
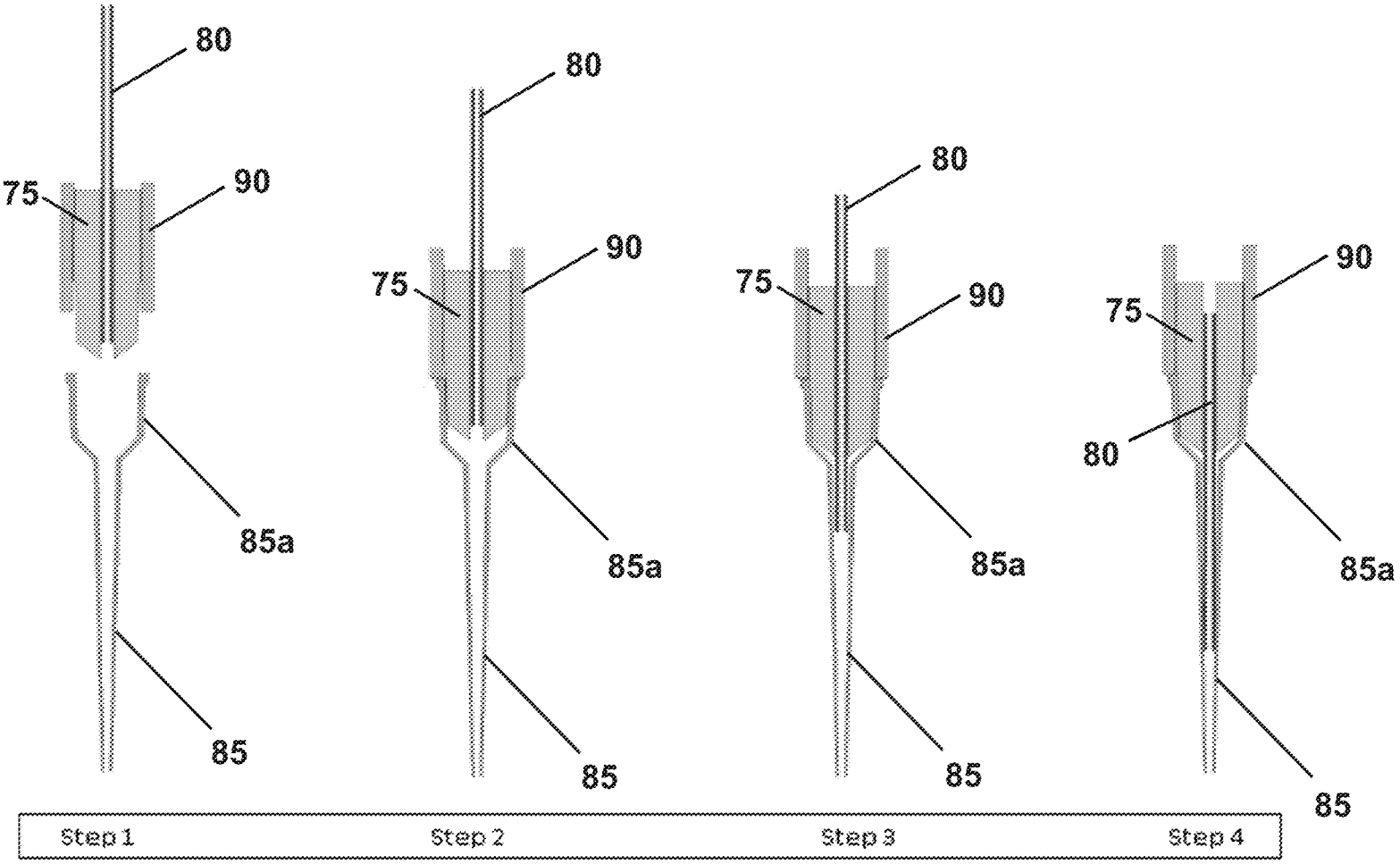
FIG. 6 schematically illustrates another exemplary embodiment of a retractable protective sleeve element of an exemplary sub-1 μL pipette, along with its method of operation.

Yet another exemplary embodiment of a metal tube protective structure is depicted in FIG. 6. In this exemplary embodiment, the protective structure again takes the form of an assembly including a retractable protective sleeve 75 that is a part of an associated sub-1 μL pipette. As shown, what would otherwise be the protruding distal end of the metal tube 80 is again located within the protective sleeve 75 prior to installation of a pipette tip 85.

The metal tube protective assembly of FIG. 6 further includes a sliding outer sleeve 90 that overlies the protective sleeve 75. The outer sleeve 90 is engageable with a locking mechanism (not shown) that prohibits retraction of the protective sleeve 75 when no pipette tip 85 is installed to the pipette (or the outer sleeve is not otherwise intentionally slid proximally). However, as illustrated in Step 2 of FIG. 6, when the pipette tip 85 is installed over the protective sleeve 75, a leading face of the proximal mounting portion 85*a* of the pipette tip 85 eventually contacts the distal face of the outer sleeve 90. As indicated by Steps 3-4 of FIG. 6, further installation of the pipette tip 85 causes the outer sleeve 90 to slide in a proximal direction, which releases the locking mechanism and allows the protective sleeve 75 to retract in a proximal direction, thereby exposing the metal tube 80 and allowing the distal end of the metal tube to enter a liquid handling portion of the pipette tip 85 and to seal against the interior wall thereof as the protective sleeve becomes fully retracted.

The protective sleeve 35, 55, 75 of any of the metal tube protective assemblies illustrated in FIGS. 4-6 may be spring loaded for automatic return of the protective sleeve to the extended (protective) position shown in Step 1 of each said drawing figure upon ejection of the pipette tip 45, 65, 85. The spring force of the spring used to return the retracted protective sleeve 35, 55, 75 to the protective position may be selected to be less than the frictional force created between the distal end of the metal tube 40, 60, 80 and the inner wall of the pipette tip 45, 65, 85, such that frictional engagement of the pipette tip with the metal tube is sufficient by itself to retain the retracted position of the protective sleeve until the pipette tip is deliberately ejected. If further protective sleeve retention force is required, the pipette tip 45, 65, 85 may also frictionally engage the protective sleeve 35, 55, 75 to provide additional, non-sealing frictional engagement for that purpose.

A spring-loaded button or similar element may replace the levers of the metal tube protective assemblies of FIGS. 4-6 in other embodiments. Also, other embodiments may use different means to retain a retracted protective sleeve and to cause its return to an extended protective position after tip ejection.

In another exemplary metal tube protective assembly embodiment (not shown), the protective sleeve may be a retractable sleeve that is a part of a tip ejector of an associated sub-1 μL pipette. This metal tube protective assembly embodiment is similar to metal tube protective assembly embodiments described above, which are part of the tip mounting shaft of the pipette.

In contrast, however, a tip ejector is normally retracted and is not placed in close proximity to a pipette tip until the tip is fully installed to the pipette. Consequently, various modifications to typical tip ejector design and operation may be employed to enable a metal tube-protective retractable sleeve to be a part of the tip ejector.

In one such design variation, the tip ejector stays in a depressed position, and a side button or lever is provided to contact the tip. As the side button or lever is depressed, the tip ejector will be released and a spring—which exerts a spring force in the opposite direction of the spring described above in regard to the metal tube protective assemblies of FIGS. 4-6—will retract the tip ejector. Thus, during normal use, the tip ejector will remain (e.g., latch) in the depressed (lower) position to protect the metal tube.

In another variation, the tip ejector is modified substantially as described above. However, in this case, the tip ejector stays depressed until a user depresses a button, whereafter the tip ejector will be released and the aforementioned spring will retract the tip ejector. As with the previous variation, the tip ejector will remain (e.g., latch) in the depressed (lower) position during normal use to protect the metal tube.

In still another variation, the protective sleeve is part of an energy storage tip ejector. Such energy storage tip ejector technology is described in several patents issued to Rainin Instrument (see, e.g., U.S. Pat. No. 6,871,557).

Figure 7A:
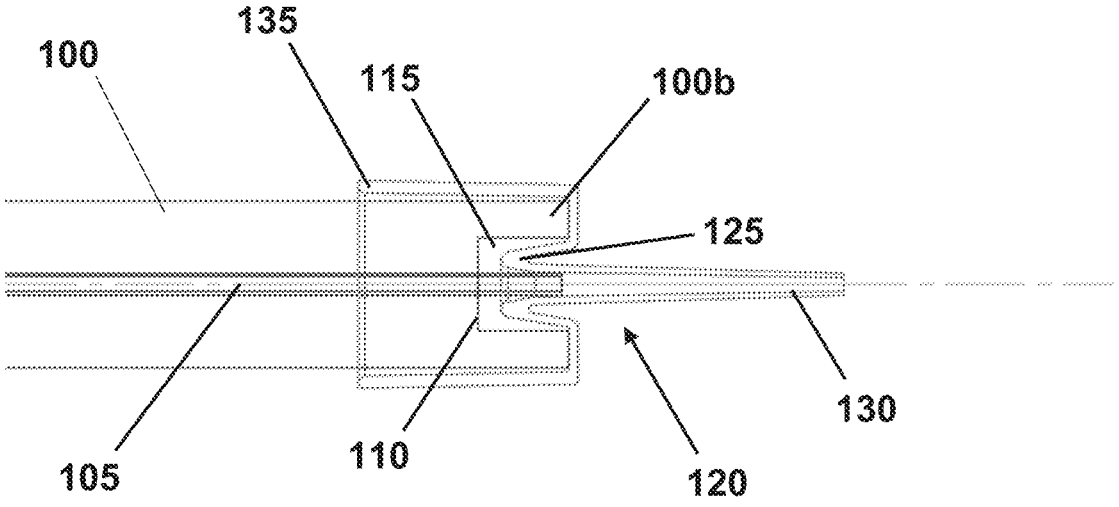
FIG. 7A schematically illustrates an exemplary embodiment of a sub-1 μL pipette with a specially designed tip mounting shaft and a correspondingly designed pipette tip.

In another alternative exemplary embodiment of a sub-1 μL pipette, shielding the protruding portion of the metal tube may be accomplished using a specially-designed tip mounting shaft in conjunction with a complimentarily-designed pipette tip. One such exemplary combination of pipette shaft and pipette tip design is illustrated in FIG. 7A. As shown, a tip mounting shaft 100 of an exemplary sub-1 μL pipette may have a distal end 100*b* that extends slightly past the distal end of the metal tube 105 of the pipette.

The distal end 100*b* of the tip mounting shaft 100 also includes an axial cavity 110 into which the distal end of the metal tube 105 protrudes. The diameter of the cavity 110 is larger than the outer diameter of the metal tube 105 so as to provide an annular gap 115 therebetween that is of sufficient dimension to receive therein a sealing region 125 of a specially designed pipette tip 120. A liquid handling portion 130 of the pipette tip 120 extends distally from the sealing region 125, while a forward portion 135 extends proximally from the sealing region and is designed to receive therein the distal end 100*b* of the tip mounting shaft 100. The interior wall of the forward portion 135 may or may not be in contact with the outer surface of the tip mounting shaft 100 when the pipette tip 120 is installed thereon.

The combined design of the tip mounting shaft 100 and the pipette tip 120 allows the distal end of the metal tube 105 to seal with the inner surface of the pipette tip at a location that results in a minimal ullage volume, without the metal tube projecting beyond the distal end 100*b* of the tip mounting shaft 100 when no pipette tip is installed thereto.

Figure 7B:
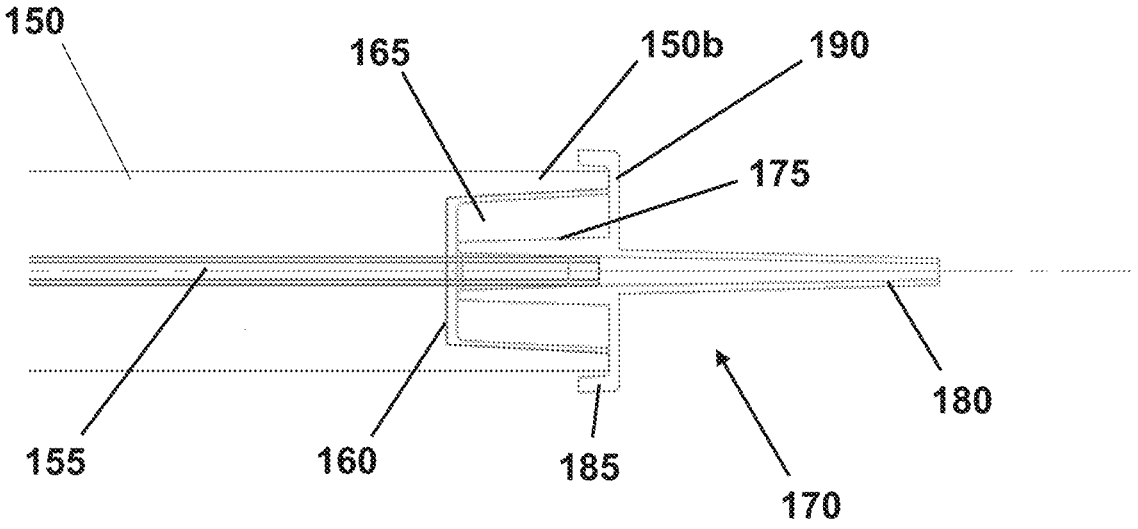
FIG. 7B schematically illustrates another exemplary embodiment of a sub-1 μL pipette with a specially designed tip mounting shaft and a correspondingly designed pipette tip.

Another alternative exemplary embodiment of a sub-1 μL pipette wherein shielding the protruding portion of the metal tube is accomplished using a specially-designed tip mounting shaft in conjunction with a complimentarily-designed pipette tip is shown in FIG. 7B. As shown, a tip mounting shaft 150 of an exemplary sub-1 μL pipette again includes a distal end 150*b* that extends slightly past the distal end of the metal tube 155 of the pipette.

The distal end 150*b* of the tip mounting shaft 150 also again includes an axial cavity 160 into which the distal end of the metal tube 155 protrudes. The diameter of the cavity 160 is again larger than the outer diameter of the metal tube 155 so as to provide an annular gap 165 therebetween that is of sufficient dimension to receive therein a combined sealing-retention region 175 of a specially designed pipette tip 170. The axial cavity 160 and the combined sealing-retention region 175 of the pipette tip 170 may have complimentary tapering profiles so as to facilitate insertion and removal of the pipette tip to and from the tip mounting shaft 150.

A liquid handling portion 180 of the pipette tip 170 extends distally from the sealing-retention region 175. The pipette tip 170 may further include a peripheral rib 185 that is connected to the sealing-retention region 175 by a flange 190. The peripheral rib 185 strengthens the flange and may serve as a contact point for a tip ejector of a pipette that is so equipped. In other embodiments, the rib 185 may be omitted and the flange 190 itself may serve as a tip ejector contact point. The inner wall of the peripheral rib 185 may or may not be in contact with the outer surface of the tip mounting shaft 150 when the pipette tip 180 is installed thereon.

The combined design of the tip mounting shaft 150 and the pipette tip 170 allows the distal end of the metal tube 155 to seal with the inner surface of the pipette tip at a location that results in minimal ullage volume, without the metal tube projecting beyond the distal end 150*b* of the tip mounting shaft 150 when no pipette tip is installed thereto.

While certain embodiments of the invention are described in detail above, the scope of the invention is not considered limited by such disclosure, and modifications are possible without departing from the spirit of the invention as evidenced by the following claims:

The invention claimed is:

1. A sub-1 μL pipette, comprising:

a body;

a tip mounting portion located at a distal end of the body;

a hollow metal tube concentrically arranged within the tip mounting portion and protruding some distance from a distal end of the tip mounting portion thereof;

a piston located within the metal tube and adapted for reciprocating movement therein; and a pipette tip of known volume, the pipette tip having a distal opening and attached by a proximal end to the tip mounting portion of the pipette, wherein a distal end of the hollow metal tube forms a seat with an inner surface of the pipette tip near the distal opening thereof so as to produce a minimized ullage volume.

2. The pipette of claim 1, wherein the wall thickness of the hollow metal tube is approximately 0.01 inches.

3. The pipette of claim 1, wherein the hollow metal tube is manufactured from a nickel and titanium alloy with superelastic properties.

4. The pipette of claim 1, wherein the distal end of the hollow metal tube forms a seal with the inner surface of the pipette tip proximate an expected location of a surface of a maximum volume of liquid that can be aspirated into the pipette tip at a given pipette volume setting.

5. The pipette of claim 1, wherein the distal end of the hollow metal tube forms a seal with the inner surface of the pipette tip at a location slightly above a minimum length pipette filter, where the bottom of the filter is located proximate an expected location of a surface of a maximum volume of liquid that can be aspirated into the pipette tip at a given pipette volume setting.

6. The pipette of claim 1, further comprising a metal tube protective structure in the form of a retractable sleeve that is associated with the tip mounting portion and surrounds the protruding portion of the hollow metal tube when no pipette tip is installed on the pipette.

7. The pipette assembly of claim 6, wherein pipette tip retention is provided by engagement between a mount portion of the pipette tip and a cooperating tip receiving portion of the retractable sleeve.

8. The pipette assembly of claim 6, further comprising a locking mechanism adapted to prohibit retraction of the protective sleeve when no pipette tip is installed on the pipette.

9. The pipette assembly of claim 8, further comprising a lever that is adapted to release the locking mechanism upon sufficient engagement of the lever by a pipette tip.

10. The pipette assembly of claim 8, further comprising a sliding outer sleeve overlying the retractable sleeve, the outer sleeve adapted to release the locking mechanism upon sufficient engagement of the outer sleeve by a pipette tip.

11. The pipette of claim 1, wherein the metal tube has an outside diameter less than 0.03 inches.

12. A sub-1 μL pipette assembly, comprising:

a pipette, the pipette including:

a body, a tip mounting portion located at a distal end of the body, a small diameter hollow metal tube concentrically arranged within the tip mounting portion and protruding some distance from a distal end of the tip mounting portion thereof, and a piston located within the metal tube and adapted for reciprocating movement therein; and a removable pipette tip of known volume installed on the tip mounting portion of the pipette, the pipette tip having a proximal mount portion and a distal opening;

wherein, a distal end of the hollow metal tube forms a sea with an inner surface of the pipette tip near the distal opening thereof so as to produce a minimized ullage volume.

13. The pipette assembly of claim 12, wherein the outer diameter of the hollow metal tube is less than 0.03 inches.

14. The pipette assembly of claim 12, wherein the wall thickness of the hollow metal tube is approximately 0.01 inches.

15. The pipette assembly of claim 12, wherein the hollow metal tube is manufactured from a nickel and titanium alloy with superelastic properties.

16. The pipette assembly of claim 12, wherein the distal end of the hollow metal tube forms a seal with the inner surface of the pipette tip proximate an expected location of a surface of a maximum volume of liquid that can be aspirated into the pipette tip at a given pipette volume setting.

17. The pipette assembly of claim 12, wherein the distal end of the hollow metal tube forms a seal with the inner surface of the pipette tip at a location slightly above a minimum length pipette filter, where the bottom of the filter is located proximate an expected location of a surface of a maximum volume of liquid that can be aspirated into the pipette tip at a given pipette volume setting.

18. The pipette assembly of claim 12, further comprising a metal tube protective structure in the form of a retractable sleeve that is associated with the tip mounting portion and adapted to surround the protruding portion of the hollow metal tube when no pipette tip is installed on the pipette.

19. The pipette assembly of claim 18, wherein pipette tip retention is provided by engagement between the mount portion of the pipette tip and a cooperating tip receiving portion of the retractable sleeve.

20. The pipette assembly of claim 18, further comprising a locking mechanism adapted to prohibit retraction of the protective sleeve when no pipette tip is installed on the pipette.

21. The pipette assembly of claim 20, further comprising a lever that is adapted to release the locking mechanism upon sufficient engagement of the lever by the pipette tip.

22. The pipette assembly of claim 20, further comprising a sliding outer sleeve overlying the retractable sleeve, the outer sleeve adapted to release the locking mechanism upon sufficient engagement of the outer sleeve by a pipette tip.

23. A sub-1 μL pipette, comprising:

a body;

a tip mounting portion located at a distal end of the body;

a small diameter hollow metal tube concentrically arranged within the tip mounting portion and protruding some distance from a distal end of the tip mounting portion thereof;

a piston located within the metal tube and adapted for reciprocating movement therein; and a retractable protective sleeve associated with a distal end of the tip mounting portion, the retractable protective sleeve having a distally located pipette tip receiving portion and configured to surround the protruding portion of the hollow metal tube when no pipette tip is installed on the pipette.

24. The pipette of claim 23, wherein the outside diameter of the hollow metal tube is less than 0.03 inches.

25. The pipette of claim 23, wherein the wall thickness of the hollow metal tube is approximately 0.01 inches.

26. The pipette of claim 23, wherein the hollow metal tube is manufactured from a nickel and titanium alloy with superelastic properties.

27. The pipette of claim 23, further comprising a locking mechanism adapted to prohibit retraction of the protective sleeve when no pipette tip is installed on the pipette.

28. The pipette of claim 27, further comprising a lever that is adapted to release the locking mechanism upon sufficient engagement of the lever by a pipette tip.

29. The pipette of claim 27, further comprising a sliding outer sleeve overlying the retractable sleeve, the outer sleeve adapted to release the locking mechanism upon sufficient engagement of the outer sleeve by a pipette tip.

30. The pipette of claim 23, further comprising a pipette tip of known volume, the pipette tip having a distal opening and attached by a proximal end to the tip receiving portion of the retractable protective sleeve of the pipette.

31. The pipette of claim 30, wherein a distal end of the hollow metal tube forms a seal with an inner surface of the pipette tip near the distal opening thereof so as to produce a minimized ullage volume.

32. The pipette of claim 31, wherein the distal end of the hollow metal tube forms a seal with the inner surface of the pipette tip proximate an expected location of a surface of a maximum volume of liquid that can be aspirated into the pipette tip at a given pipette volume setting.

33. The pipette of claim 31, wherein the distal end of the hollow metal tube forms a seal with the inner surface of the pipette tip at a location slightly above a minimum length pipette filter, where the bottom of the filter is located proximate an expected location of a surface of a maximum volume of liquid that can be aspirated into the pipette tip at a given pipette volume setting.

* * * * *